US005727407A

United States Patent [19]

Cowen

[11] Patent Number: 5,727,407

[45] Date of Patent: Mar. 17, 1998

[54] SECURITY DEVICE FOR EXIT DOORS

[75] Inventor: Nicholas Cowen, Potters Bar, United Kingdom

[73] Assignee: Castell Safety International Limited, London, United Kingdom

[21] Appl. No.: 677,769

[22] Filed: Jul. 10, 1996

[51] Int. Cl.[6] ..... E05B 11/00

[52] U.S. Cl. ..... 70/389; 70/339; 70/337

[58] Field of Search ..... 70/337, 339, 389, 70/DIG. 63, 338, DIG. 49

[56] References Cited

U.S. PATENT DOCUMENTS

| | | | |
|---|---|---|---|
| 2,220,786 | 11/1940 | Grainger | 70/389 |
| 2,966,053 | 12/1960 | Mintz | 292/264 |
| 4,651,544 | 3/1987 | Hungerford | 70/63 |
| 4,815,305 | 3/1989 | Smith | 292/264 |
| 5,285,666 | 2/1994 | Bartnicki | 292/264 |
| 5,460,020 | 10/1995 | Hungerford | 70/63 |

FOREIGN PATENT DOCUMENTS

| | | |
|---|---|---|
| 2278391 | 5/1993 | United Kingdom . |
| 2280705 | 2/1995 | United Kingdom . |

*Primary Examiner*—Steven N. Meyers
*Assistant Examiner*—Tuyet-Phuong Pham
*Attorney, Agent, or Firm*—Cesari and McKenna, LLP

[57] ABSTRACT

An exit door has a security device comprising a flexible member, e.g. a chain, for connecting two locking devices which may be fixed on a door and doorway or on double doors. The first locking device is operable by a first key removable only when the locking device is activated and a second key removable only when the locking device is deactivated. One end of the flexible member is fixed to the second key and the other end is fixed to the second locking device, which is operable by the second key, being removable from the second locking device only when it is activated, and by a third key removable only when the second locking device is deactivated. The security devices are members of a series of such security devices in which the third key of each security device serves as the first key of the next security device in the series. The last key in the series is essential to operation of a control unit permitting use of a building provided with the exit door.

8 Claims, 3 Drawing Sheets

SECURITY DEVICE FOR EXIT DOORS

BACKGROUND TO THE INVENTION

Buildings (such as cinemas, theaters, concert halls, stadia, art galleries, historic houses, schools, commercial premises, and offices) having one or more areas which are periodically open to the public are required to have exit doors allowing the occupants to escape without hindrance in the event of an emergency such as a fire.

Conventional escape doors can be opened only from the inside. Often they have a crash bar escape mechanism in which the pushing of a crash bar on the inside of the door causes longitudinal movement of a latching bar, thereby releasing it from engagement with a striker fixed to the doorway. Such doors, particularly large ones or double doors, provide an easy means of entry or escape for unauthorised persons and facilitate the theft of large pieces of valuable equipment such as computers.

For this reason, it is a known practise to lock emergency exit doors, against the advice of the fire authorities, when a building is not in use. The danger is that one or more of these doors may inadvertently be left locked when the building is in use, which constitutes a very grave hazard should a fire occur.

Electronic/electrical systems are available which centrally control automatic locking/unlocking of the emergency exit doors when required. These may be linked to an alarm system so as to ensure that the doors are unlocked before the building is used. Such electronic/electrical systems are expensive to install and are difficult to fit to existing emergency exit doors. They are also costly to maintain.

It would be desirable to be able to provide a mechanical means of ensuring that the emergency exit doors are secured when the building (or part open to the public) is closed but not when the building (or part) is opened.

The present invention is a further development of the invention described in GB-A-2 278 391, aiming at increased security.

SUMMARY OF THE INVENTION

In one aspect the invention provides a building including means for selectively inhibiting and permitting use of an area inside the building, and a plurality of exit doors allowing escape from the said area, each exit door having a locking device which is operable by two keys, one key being removable only when the locking device is activated and the other key being removable only when the locking device is deactivated, each locking device being a member of a series of such locking devices in which the said other key of each locking device serves as the said one key of the next locking device in the series, all the keys being different, and the said other key of the last locking device of the series being essential to operation of the said means to permit use of the said area, wherein at least one pair of successive locking devices in the series forms part of a security device which includes a flexible member for connecting the two locking devices of the pair, one end of the flexible member being fixed to the said other key of one of the said two locking devices, which serves as the said one key of the other of the said two locking devices, the other end of the flexible member being fixed to the said other locking device.

The last key may be used in a variety of ways to permit or enable use of the building or part of the building, depending on the nature of the building and its intended use. For instance, it could be used to disable an alarm system, turn on a lighting system, activate a cash till, raise a car park barrier, etc.

In another aspect, the invention provides an exit door having a security device including a first locking device which is operable by first and second keys, the first key being removable only when the locking device is activated and the second key being removable only when the locking device is deactivated, wherein the security device includes a second locking device which is operable by the second key and a third key, the second key being removable from the second locking device only when the second locking device is activated and the third key being removable from the second locking device only when the second locking device is deactivated, the security device including a flexible member for connecting the two locking devices, one end of the flexible member being fixed to the second key and the other end of the flexible member being fixed to the second locking device.

In a further aspect, the invention provides a security device for an exit door, the security device comprising a first locking device which is operable by first and second keys, the first key being removable only when the locking device is activated and the second key being removable only when the locking device is deactivated, wherein the security device includes a second locking device which is operable by the second key and a third key, the second key being removable from the second locking device only when the second locking device is activated and the third key being removable from the second locking device only when the second locking device is deactivated, the security device including a flexible member for connecting the two locking devices, one end of the flexible member being fixed to the second key and the other end of the flexible member being fixed to the second locking device.

BRIEF DESCRIPTION OF THE DRAWINGS

The invention will be described further, by way of example, with reference to the accompanying drawings, in which.

Figure 1:
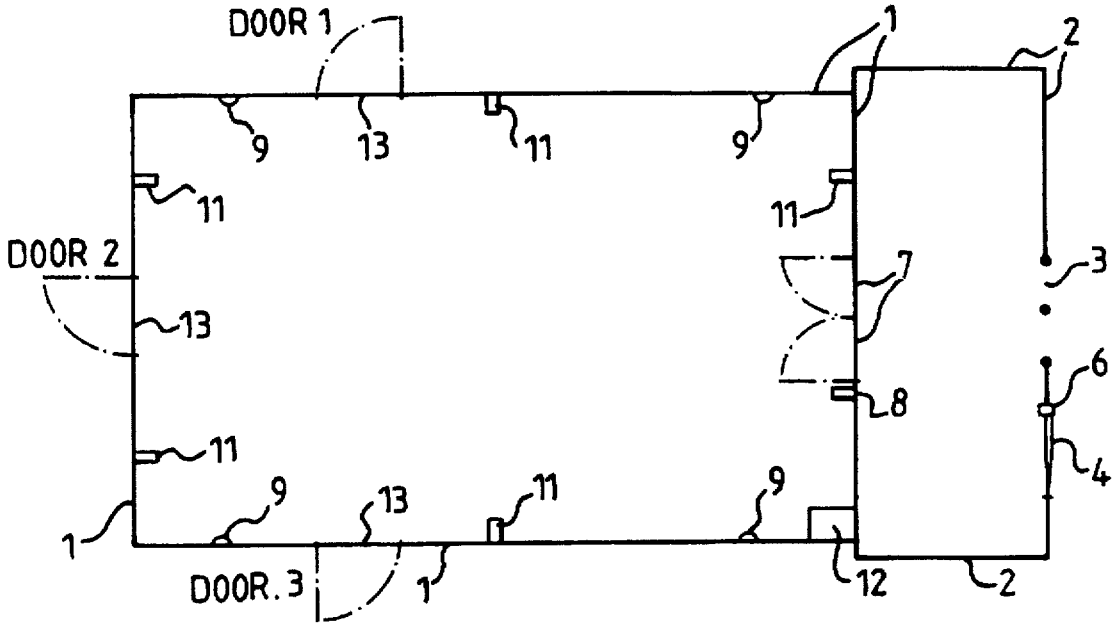
FIG. 1 is a diagrammatic plan view of the ground floor of a building.

The building shown in FIG. 1 has four walls 1 defining an enclosure, which may be roofed or may be surmounted by one or more floors. The building also includes fences 2 defining a forecourt having a pedestrian access 3 and a vehicular access closable by a barrier 4 which can be raised and lowered automatically by a drive unit 6. The front wall 1 has main entrance doors 7 which can be locked and unlocked by a remote controlled unit 8. The building has a lighting system including interior lights 9 and an alarm system including detectors 11. A central control unit 12 controls the units 6 and 8, the lighting system, and the alarm system. The control unit 12 is switchable between (a) a building use permitting mode, in which the drive unit 6 is operable to open the vehicular access, the remote controlled unit 8 unlocks the entrance doors 7, the lighting system is powered, and the alarm system is disabled, and (b) a building use inhibiting mode, in which the drive unit 6 keeps the barrier 4 closed, the unit 8 locks the entrance doors 7 closed, the lighting system is disconnected from the power supply, and the alarm system is primed.

The building has exit doors 13 which can be opened from the inside in the event of a fire or other emergency. By way of example, each door 13 has a latching device which is readily releasable by pushing. Such devices (e.g. those sold under the trade mark "BRITON") are well known and comprise at least one longitudinally movable latching bar 16 whose end engages a striking plate fixed to the doorway 18, a crash bar (not shown) pivotally mounted so that it can be pushed towards the door, and a transmission unit for converting the movement of the crash bar into longitudinal movement of the latching bar 16 so as to disengage it from the striking plate.

Figure 3:
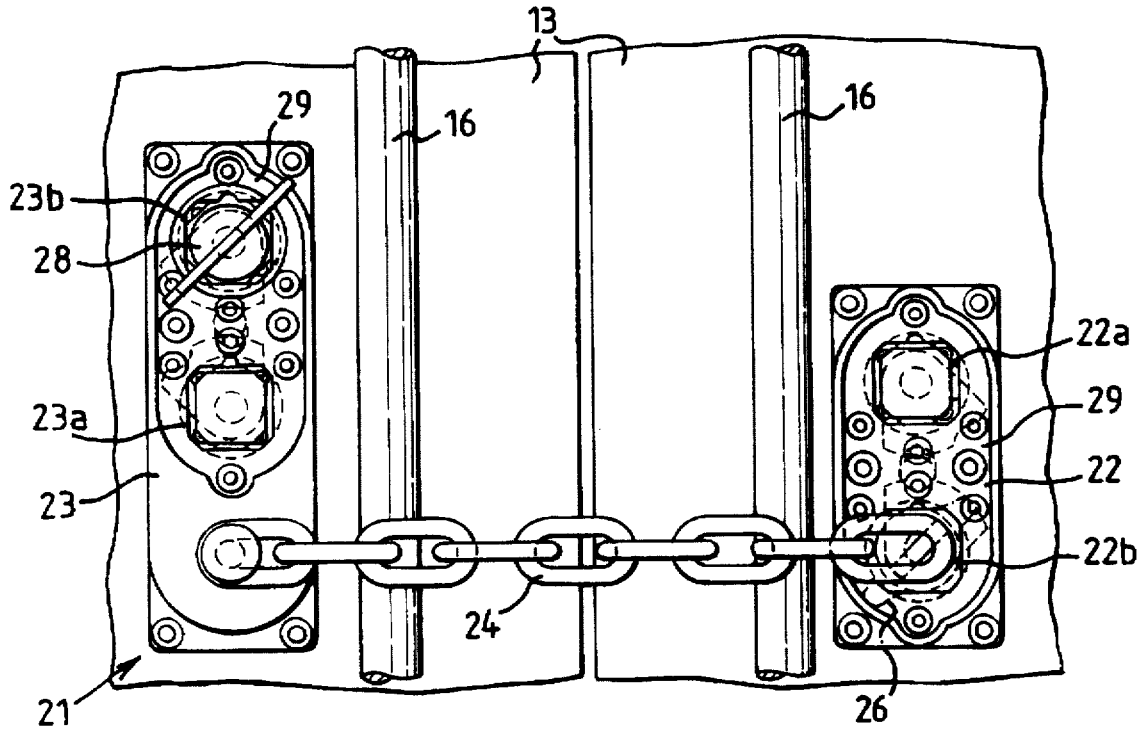
FIG. 3 shows a security device on a double door.

Each door 13 has a security device 21 for preventing opening of the door when the building is not being used by the public. The security device 21 comprises a first locking device 22 fixed on the doorway 18, a second locking device 23 fixed on the door 13, and a flexible member in the form of a chain 24 for linking the locking devices 22,23 in order to prevent opening of the door. The chain 24 could be replaced by a cable, for example. The positions of the first and second locking devices 22,23 could be reversed. In a double door (FIG. 3) the locking devices 22,23 are fixed on the respective doors 13 and the chain 24 is longer.

Figure 5:
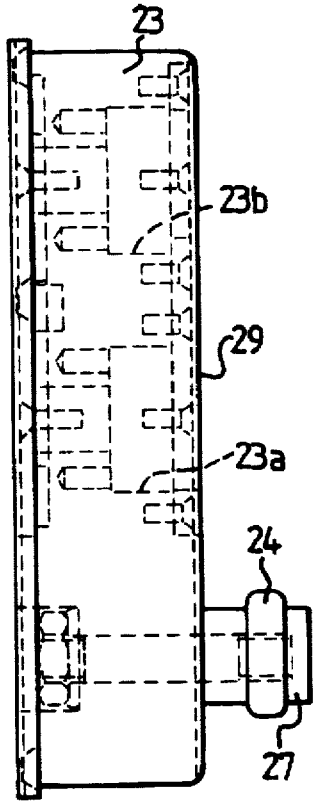
FIG. 5 is a side view of a second locking device of the security device of FIG. 3.

The first locking device 22 is operable by first and second keys, the first key being removable from its receiver 22*a* only when the locking device 22 is activated by the second key, and the second key being removable from its receiver 22*b* only when the locking device 22 is deactivated by the first key. The second key is a permanent part of the security device 21 and is constituted by a catch 26 fixed to one end of the chain 24, the other end being fixed to second locking device 23 by a bolt 27 (FIG. 5).

The second locking device 23 is operable by the second key 26 and a third key 28, the second key 26 being removable from its receiver 23*a* only when the locking device 23 is activated by the third key 28, and the third key being removable from its receiver 23*b* only when the locking device 23 is deactivated by the second key 26.

Figure 6:
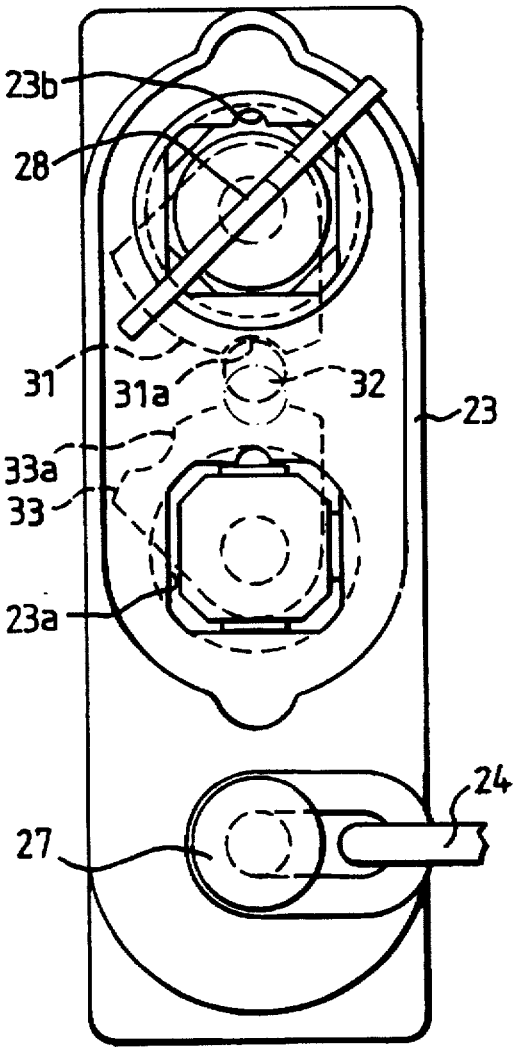
FIG. 6 is an enlarged elevation of the second locking device, with inessential parts omitted for the sake of clarity.
Figure 4:
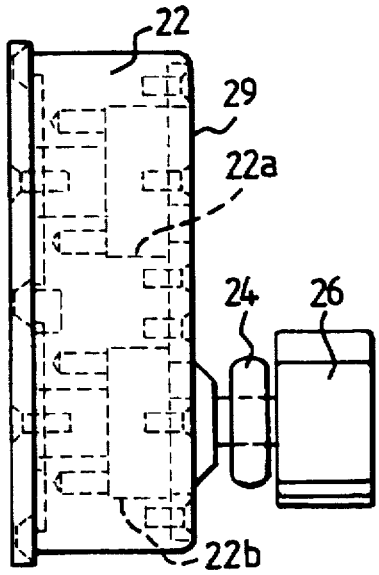
FIG. 4 is a side view of a first locking device of the security device of FIG. 3.

An interlocking mechanism is provided in each locking device 22,23 and will now be described with reference to the second locking device 23 as shown in FIG. 6. The key 28, trapped in its receiver 23*b*, is in engagement with a sector cam 31 having a recess 31*a* which receives a vertically movable element 32. The element 32 is held in the recess 31*a* by a sector cam 33 which is to be engaged by the key 26. Thus the sector cam 31 (and with it the key 28) is prevented from turning. After the key 26 is inserted into its receiver 23*a*, engaging the cam 33, it is turned clockwise through 45° (trapping it in the receiver) so that a recess 33*a* in the cam 33 comes into alignment with the element 32, allowing it to escape from the opposite recess 31*a* when the key 28 is turned counterclockwise through 45° to release it from its receiver 23*b*. The cam 31 then prevents the element 32 from escaping from the recess 33*a*.

The above-described interlock mechanism is given as an example. Other interlock mechanisms are available, such as the cam mechanism described in GB-A2 280 705.

Each locking device 22,23 has a stainless steel front plate 29 securely screwed to the body of the device and defining square apertures for receiving and trapping the respective keys. The catch 26 is also made of stainless steel. Thus the security device 21 is strong, in order to resist forced entry.

Figure 2:
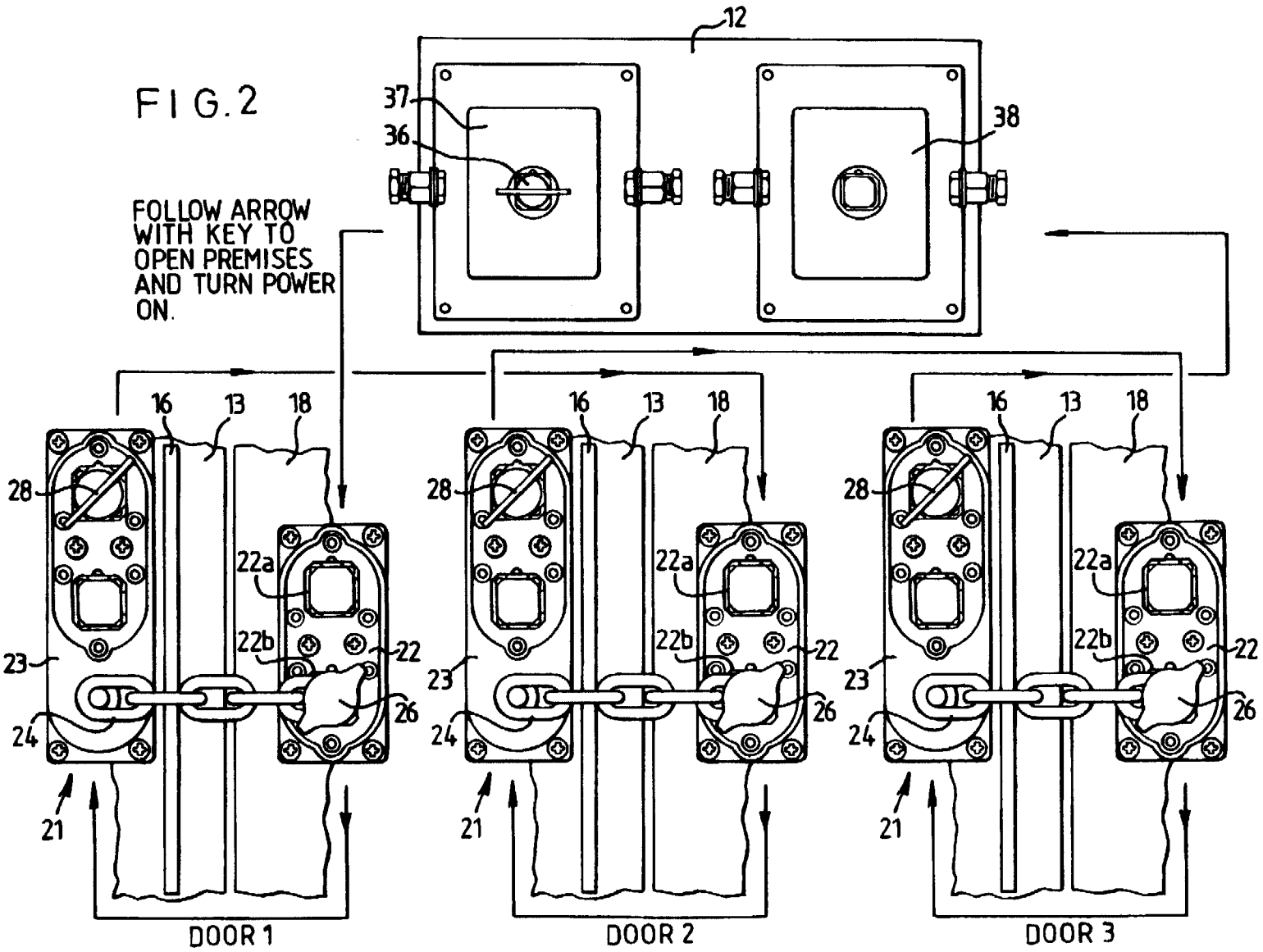
FIG. 2 diagrammatically shows a control unit and a series of security devices on the emergency exit doors of the building.

The security devices 21 of the exit doors 13, taken in a logical sequence (DOOR 1, DOOR 2, DOOR 3), constitute a series (FIG. 2) in which the third key 28 of each security device serves as the first key of the next security device in the series, all the keys being coded differently. The initial key 36 of the sequence (i.e. the first key of the first security device in the series) and the final key of the sequence (i.e. the third key 28 of the last locking device in the series) are used to operate respective switches 37,38 on the central control unit 12, so that the initial key is necessary to operation of the control unit in a building use inhibiting mode (e.g. turning off a power supply) and the final key is necessary to operation of the control unit in the use permitting mode (e.g. turning on a power supply).

Thus it can be ensured that use of the building is prevented until all the exit doors 13 have been unchained in sequence, thereby releasing the final key. Conversely, when the building is closed, the use permitting mode is cancelled and the final key is removed from the control unit 12 (which is therefore in a neutral state intermediate the permitting and inhibiting modes), the doors 13 are chained in reverse sequence, and the initial key is released, thereby allowing the control unit to be switched to the use inhibiting mode only after all the doors 13 have been secured.

A significant advantage of the security device 21 is that the catch 26 (second key) is held captive both when the door is chained and when the door is unchained. This prevents unauthorised persons from tampering with the catch.

The series of locking devices may include one or more locking devices which are not associated with emergency exit doors or which do not form part of a security device incorporating a chain.

There may be more than one series of locking devices (and associated emergency exit doors) so that use of one or more areas or zones of a building may be selectively inhibited and permitted, independently of other areas.

What is claimed is:

1. A building including means for selectively inhibiting and permitting use of an area inside the building, and a plurality of exit doors allowing escape from the said area, each exit door having a locking device which includes and is operated by two keys, one key being removable from the locking device only when the locking device is activated and the other key being removable from the locking device only when the locking device is deactivated, each locking device being a member of a series of such locking devices in which the said other key of each locking device serves as the said one key of the next locking device in the series, all the keys being different, and the said other key of the last locking device of the series being essential to operation of the said means to permit use of the said area, wherein at least one pair of successive locking devices in the series forms part of a security device which includes a flexible member for connecting the two locking devices of the pair, one end of the flexible member being fixed to the said other key of one of the said two locking devices, which serves as the said one key of the other of the said two locking devices, the other end of the flexible member being fixed to the said other locking device.

2. A building as claimed in claim 1, in which the said one key of the first locking device in the series is essential to operation of the said means to inhibit use of the said area.

3. A building as claimed in claim 1, in which the said means comprises an alarm system.

4. An exit door having a security device including a first locking device which includes and is operated by first and second keys, the first key being removable from the first locking device only when the first locking device is activated and the second key being removable from the first locking device only when the first locking device is deactivated, wherein the security device includes a second locking device which is operable by the second key and a third key, the second key being removable from the second locking device only when the second locking device is activated and the third key being removable from the second locking device only when the second locking device is deactivated, the security device including a flexible member for connecting the two locking devices, one end of the flexible member being fixed to the second key and the other end of the flexible member being fixed to the second locking device.

5. An exit door as claimed in claim 4, comprising a door and a doorway, the two locking devices being mounted respectively on the door and the doorway.

6. An exit door as claimed in claim 4, being a double door comprising two doors, on which the two locking devices are respectively mounted.

7. An exit door as claimed in claim 4, including a latching device which is mounted on the inside of the door and which is releasable only from inside the door.

8. A security device for an exit door, the security device comprising a first locking device which includes and is operated by first and second keys, the first key being removable only from the first locking device when the first locking device is activated and the second key being removable only from the first locking device when the locking device is deactivated, wherein the security device includes a second locking device which is operable by the second key and a third key, the second key being removable from the second locking device only when the second locking device is activated and the third key being removable from the second locking device only when the second locking device is deactivated, the security device including a flexible member for connecting the two locking devices, one end of the flexible member being fixed to the second key and the other end of the flexible member being fixed to the second locking device.

* * * * *